United States Patent [19]

Ogawa et al.

[11] Patent Number: 4,915,637

[45] Date of Patent: Apr. 10, 1990

[54] FUNCTION-PRESET WIRING DEVICE FOR AUTOMOBILES

[75] Inventors: Kikuo Ogawa; Kikuo Kimura, both of Shizuoka, Japan

[73] Assignee: Yazaki Corporation, Tokyo, Japan

[21] Appl. No.: 220,762

[22] Filed: Jul. 15, 1988

Related U.S. Application Data

[62] Division of Ser. No. 43,353, Apr. 28, 1987, Pat. No. 4,799,893.

[30] Foreign Application Priority Data

May 2, 1986 [JP] Japan ..... 61-100900

[51] Int. Cl.[4] ..... H01R 9/09

[52] U.S. Cl. ..... 439/76; 439/81; 439/876

[58] Field of Search ..... 439/81–83, 439/76, 883, 884, 889, 874–876, 78, 329

[56] References Cited

U.S. PATENT DOCUMENTS 3,718,895 2/1973 Reynolds et al. ..... 439/876

4,799,893 1/1989 Ogawa et al. ..... 439/81

*Primary Examiner*—P. Austin Bradley

*Attorney, Agent, or Firm*—Armstrong, Nikaido, Marmelstein, Kubovcik & Murray

[57] ABSTRACT

A wiring device is provided wherein a junction block (abbreviated to "J.B.") (a) which is used for electric wiring of an automobile, and an electronic unit (b) whose case (4,5) receives therein a printed circuit plate (e) formed with a functional circuit for connecting signals between wire harnesses and which is provided with a J.B. coupling connector (8) and an external coupling connector (7) at an outer periphery of the case, are detachably connected by the J.B. coupling connector. Signals from the function block are transmitted to the J.B. by way of a function-preset wiring device for an automobile comprising a through terminal (c) which is formed with a J.B. connecting portion ($c_1$) at one end of a base plate (9) and an external output terminal portion ($c_2$) at the other end thereof, and a branch terminal (d) which has lead terminals (23) associated with elastic sandwiching pieces (19) for receiving the external output terminal portion of the through terminals. The external output terminal portion penetrates the printed circuit plate when it is inserted between and held in contact with the elastic sandwiching pieces of the branch terminal fixed perpendicularly to the printed circuit plate by the lead terminals, whereby an end of the external output terminal portion remote from the J.B. connecting portion protrudes into the external coupling connector.

2 Claims, 5 Drawing Sheets

FUNCTION-PRESET WIRING DEVICE FOR AUTOMOBILES

This is a division of application Ser. No. 043,353, filed Apr. 28, 1987, now U.S. Pat. No. 4,799,893.

BACKGROUND OF THE INVENTION

The present invention relates to a function-preset wiring device for automobiles, and more particularly to an improved device for forming a through circuit by which signals from a junction block (hereinbelow, abbreviated to "J. B.") are externally delivered via an electronic unit detachably connected to the J. B.

Heretofore, for the electric wiring of an automobile, a J. B. in which a large number of electronic components such as relays and fuses are intensively disposed has been used to facilitate the fabrication of wire harnesses and to simplify a wiring form. Since, however, the number of the components of car electronics tends to increase year by year from the aspects of enhancements in the safety and comfortable ride and drive of the automobile, the J. B. enlarges in size and the internal circuit arrangement thereof becomes complicated. Moreover, since the structure of the J. B. is necessarily different according to the sorts and grades of automobiles, various kinds of J. B.'s need to be prepared at all times and the production and administration thereof expend a long time and much labor. Therefore, a system has been adopted wherein a basic circuit irrespective of the sorts, grades etc. of automobiles is included in a J. B. in built-in fashion, and wherein an electronic unit in which functional circuits such as a defogger, lamp control unit and a power window control unit to be selected depending upon the sorts, grades etc. of automobiles are set, is detachably connected to the J. B.

Such electronic unit is naturally equipped with a through circuit in order to have a connecting function. The through circuit is used within the unit and also extends outside it.

The formation of the through circuit will be more concretely described with reference to the drawings. In FIG. 6, numeral 30 designates a J. B. in which a bus bar circuit plate (not shown) having a desired circuit arrangement is mounted. Numeral 31 designates an electronic unit, which is provided with a J. B. coupling connector portion 33 and an external coupling connector 34 at an outer periphery of a case 32 and which receives therein a printed circuit plate 36 carrying electronic elements 35*a*, 35*b* such as resistors, capacitors, and an IC or LSI. A branch terminal 37 is fixed to a part of the circuit of the printed circuit plate 36 perpendicularly thereto by soldering, and an elongated tab terminal 38 which is erected from the bus bar of the bus bar circuit plate and formed as a continuous part thereof protrudes into the external coupling connector 34 while penetrating the printed circuit plate 36 as well as the branch terminal 37, thereby to form a through terminal for externally connecting the internal circuit of the J. B. 30. As shown in FIG. 7, the branch terminal 37 has a structure wherein the free edges of upright side walls 37*b* on both the sides of a base plate 37*a* are bent toward the base plate, and an embracing portion 37*c* for the tab terminal 38 is formed by bent parts and the base plate 37*a*, and wherein an elastic contact piece 37*d* is folded back and formed from one end of the base plate 37*a*, while a connecting pin 37*e* is protrusively provided at the other end. The connecting pin 37*e* is fixed to the circuit of the printed circuit plate 36.

The through circuit described above is constructed of the branch terminal 37 fixed to the printed circuit plate 36, and the tab terminal 38 extended from the J. B. 30. Since, however, the tab terminal 38 is comparatively long and the branch terminal 37 has the rigid body structure, the connection position of the tab terminal 38 as the through terminal is to be strictly regulated.

In the presence of a drawback such as inclination or float at the stage of fixing the branch terminal 37 to the printed circuit plate 36, or in the presence of any deformation or warp of the branch terminal itself or the dimensional error of the printed circuit plate, the connection of the branch terminal 37 with the through terminal 38 becomes difficult. An offset attributed to unreasonable connection acts as .an external force on another connection portion (a male terminal at the external coupling connector 34), so that a normal fitted state is not established, and the electrical connection becomes unstable. Moreover, since the through terminal 38 is elongate, the positioning dimensions of terminal insetting holes 30*a*, 34*a*, etc. to be formed in the J. B. 30, the electronic unit 31, etc. need to be exact, and a long time is expended for the assemblage of the J. B. and the electronic unit.

SUMMARY OF THE INVENTION

In view of the problems stated above, the present invention has for its object to provide a function-preset wiring device for automobiles which is capable of stable electrical connections without being affected by some degrees of dimensional errors of a printed circuit plate, terminals for forming a through circuit, etc. and which is easy to assemble.

In order to accomplish the object, the present invention consists in a wiring device wherein a junction block (hereinbelow, abbreviated to "J. B.") which is used for electric wiring of an automobile, and an electronic unit whose case receives therein a printed circuit plate formed with a functional circuit for connecting signals between wire harnesses and which is provided with a J. B. coupling connector and an external coupling connector at an outer periphery of the case, are detachably connected by the J. B. coupling connector; characterized by comprising a through terminal which is formed with a J. B. connecting portion at one end of a base plate and an external output terminal portion at the other end thereof, and a branch terminal which has lead terminals inscribed by elastic sandwiching pieces for receiving said external output terminal portion of said through terminal, said external output terminal portion of said through terminal penetrating the printed circuit plate under a state under which it is inserted between and held in contact with said elastic sandwiching pieces of said branch terminal fixed perpendicularly to said printed circuit plate by said lead terminals, thereby to protrude into said external coupling connector an end of said external output terminal portion remote from said J. B. connecting portion. Thus, the through terminal is provided with the J. B. connecting portion so as to be separated from a tab terminal which is erected from and formed continuously to the bus bar circuit of the J. B., and the branch terminal fixed to the printed circuit plate is endowed with a cushion function so as to compensate the positional deviations and dimensional errors of the terminals, so that the various connection parts can establish stable electrical connections without being affected by the other parts.

PREFERRED EMBODIMENT OF THE INVENTION

Figure 1:
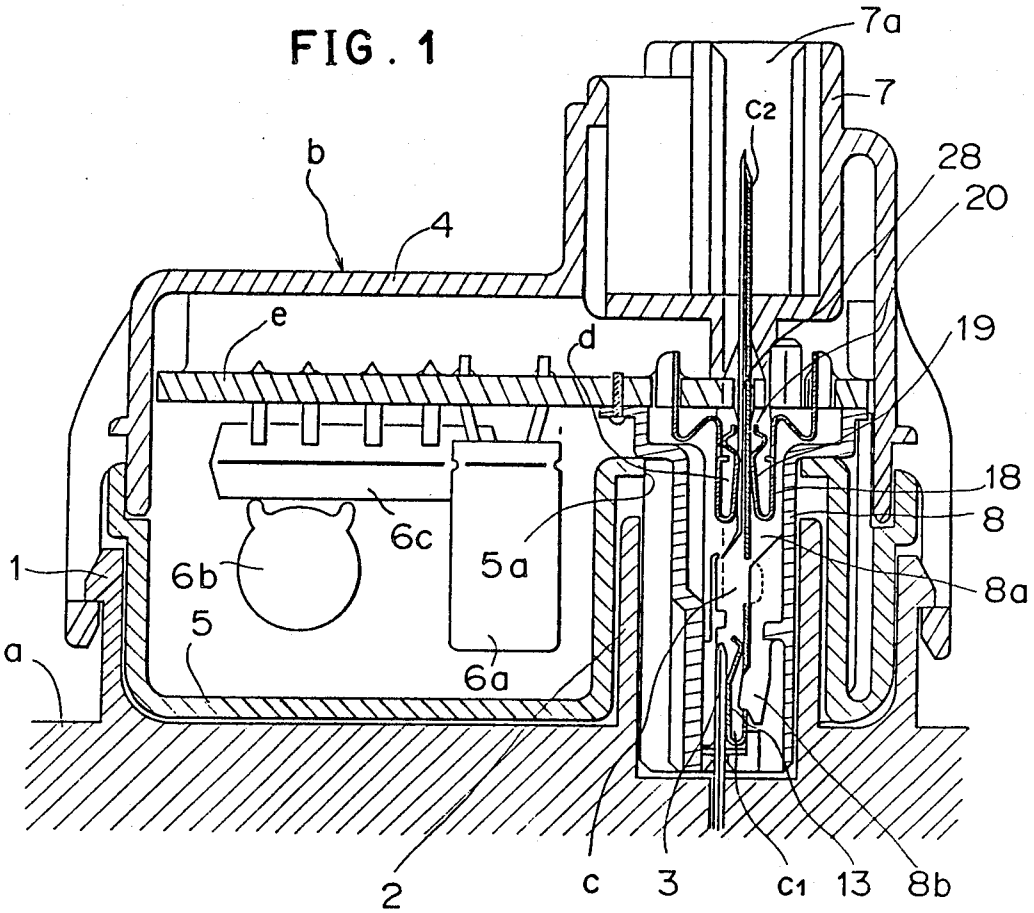
FIG. 1 is a sectional view of an assembled state showing an embodiment of the device of the present invention.

In FIG. 1, letter a indicates a J. B., letter b an electronic unit, letter c a through terminal, and letter d a branch terminal.

The J. B. receives a bus bar circuit plate, not shown, in the inner part thereof and has a snug fit frame 1 and a unit coupling connector 2 for the electronic unit b in the outer part thereof. A tab terminal 3 extending from the bus bar circuit plate protrudes into the connector 2.

The electronic unit b receives a printed circuit plate e inside a housing made by an upper case 4 and a lower case 5. The printed circuit plate e carries electronic components such as a capacitor 6*a* a resistor 6*b* and an LSI 6*c*, thereby to form a desired functional circuit. An external coupling connector 7 is formed integrally with the upper case 4, while a J. B. coupling connector 8 is fixed to the printed circuit plate e by a screw so as to protrude out of the opening 5*a* of the lower case 5. The J. B. coupling connector 8 may well be provided unitarily with the lower case 5.

The electronic unit b is coupled to the J. B. a owing to the fit engagement thereof with the snug fit frame 1 and the fit engagement between the unit coupling connector 2 and the J. B. coupling connector 8.

Figure 2:
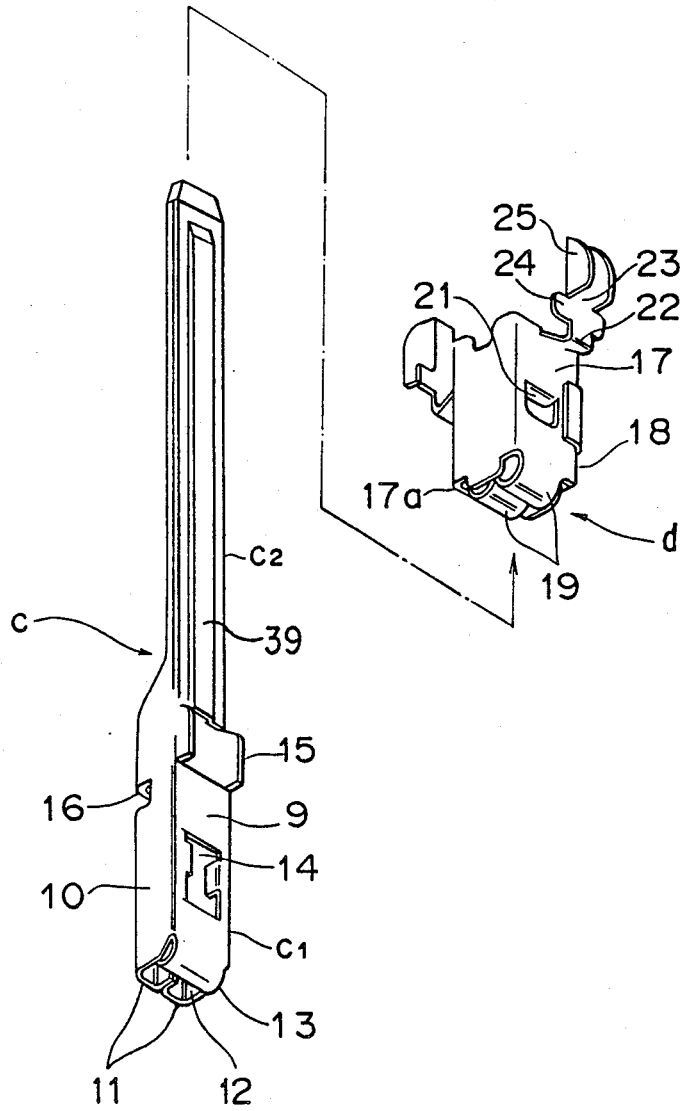
FIG. 2 is a perspective view of a through terminal and a branch terminal which constitute the device.
Figure 3A:
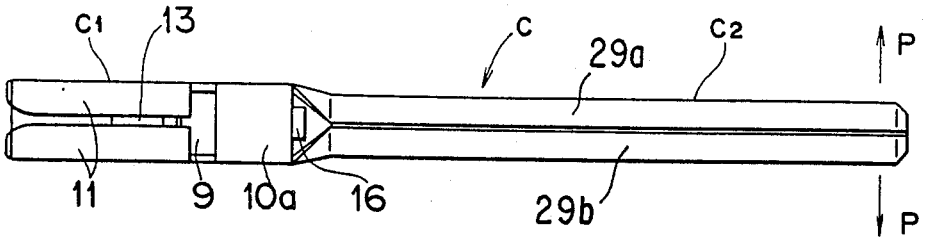
FIG. 3*a* is a plan view of the through terminal.
Figure 3B:
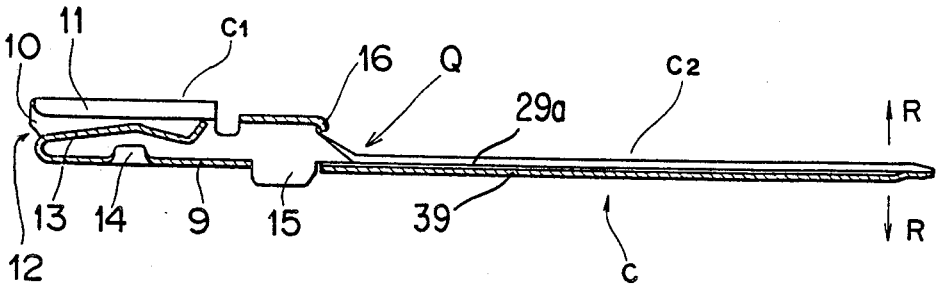
FIG. 3*b* is a vertical mid-sectional view thereof.
Figure 6:
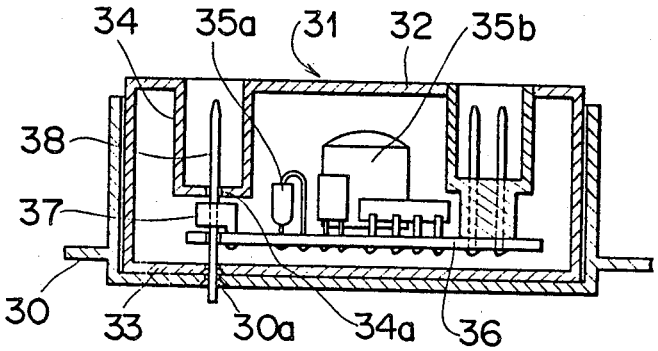
FIG. 6 Prior Art
FIG. 6 and FIG. 7 are respectively a sectional view of a wiring device and a perspective view of a branch terminal showing a prior-art example.

As illustrated in FIG. 2 and FIGS. 3*a* and 3*b*, the through terminal c is so configured that a J. B. connecting portion $c_1$ for the tab terminal 3 from the J. B. a is continuously formed on one side of a base plate 9 made of a thin plate, while an external output terminal portion $c_2$ is continuously formed on the other side.

The J. B. connecting portion $c_1$ is formed as a female terminal with a structure wherein the free edges of upright side walls 10 on both the sides of the base plate 9 are curled inside toward each other, to provide a pair of elastic sandwiching arms 11, and an embracing portion 12 for receiving the tab terminal 3 is defined between the arms 11 and the base plate 9. An while an elastic contact piece 13 which is folded back unitarily from the base plate 9 and then extended rearwards within the embracing portion 12 is provided on the inlet side of the embracing portion. Shown at numeral 14 is an engagement hole for the J. B. coupling connector 8.

The external output terminal portion $c_2$ is formed as a tab-like male terminal in which both sides of an extension at the other end of the base plate 9 are folded over as flaps 29*a* and 29*b* to define a hollow between the flaps and the base plate 9 and the base plate 9 is formed with a bear 39 extending longitudinally of the output terminal portion $c_2$.

At a position intermediate between the J. B. connecting portion $c_1$ and the external output terminal portion $c_2$, protruding pieces 15 for preventing the torsion of the terminal c are provided by cutting and raising the base plate 9 so as to extend downwards from the base plate. Further, the rear end of the butt portion 10*a* of the upright side walls 10 overlying the torsion preventing pieces 15 is bent toward the base plate 9 so as to form an erroneous insertion-preventing piece 16.

Figure 4A:
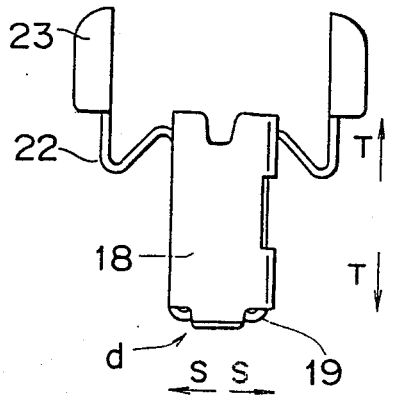
FIG. 4*a* is a side view of the branch terminal.
Figure 4B:
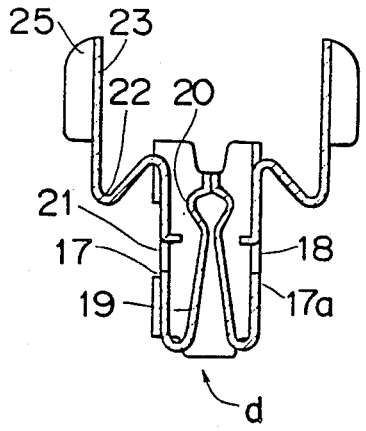
FIG. 4*b* is a sectional view thereof.
Figure 7:
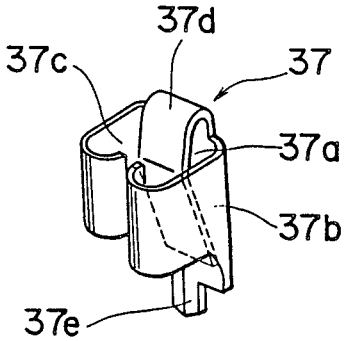
FIG. 7 Prior Art

As illustrated in FIG. 2 and FIGS. 4*a* and 4*b*, the branch terminal d is configured as follows: One side edge of a base plate 17 made of a thin plate is bent in the shape of letter U toward the other side, and a box-shaped receptacle portion 18 for receiving the tab-like external output terminal portion $c_2$ is provided between the bent parts and the base plate 17, while a pair of elastic sandwiching pieces 19 which are respectively folded back and formed in the shape of an arc or the letter V unitarily from the base plate 17 and a wall 17*a* opposing thereto are provided on the inlet side of the receptacle 18. The free edges of the elastic sandwiching pieces 19 are further curved with the fore ends of the curved parts held in contact, thereby to form adhesion preventing pieces 20 for preventing the adhesion of a coating agent at the stage of soldering. At the middle parts of the base plate 17 and the opposing wall 17*a*, permanent strain-preventing pieces 21 are provided by cutting and raising these parts so as to protrude inwards, thereby to prevent the excess flexures of the elastic sandwiching pieces 19.

On the outlet side of the receptacle portion 18 of the branch terminal d, lead terminals 23 for fixing the printed circuit plate e extend downwards and are respectively formed unitarily so as to continue to the base plate 17 and the opposing wall 17*a* via S-shaped elastic crooked portions 22. Stoppers 24 protrude on both the sides of the intermediate part of each lead terminal 23. Further, rattle preventing pieces 25 bent in the shape of letter U are formed on both the sides of the lower end part of each lead terminal 23.

Next, the connection between the through terminal c and the branch terminal d and the operations of these terminals will be described.

Figure 5:
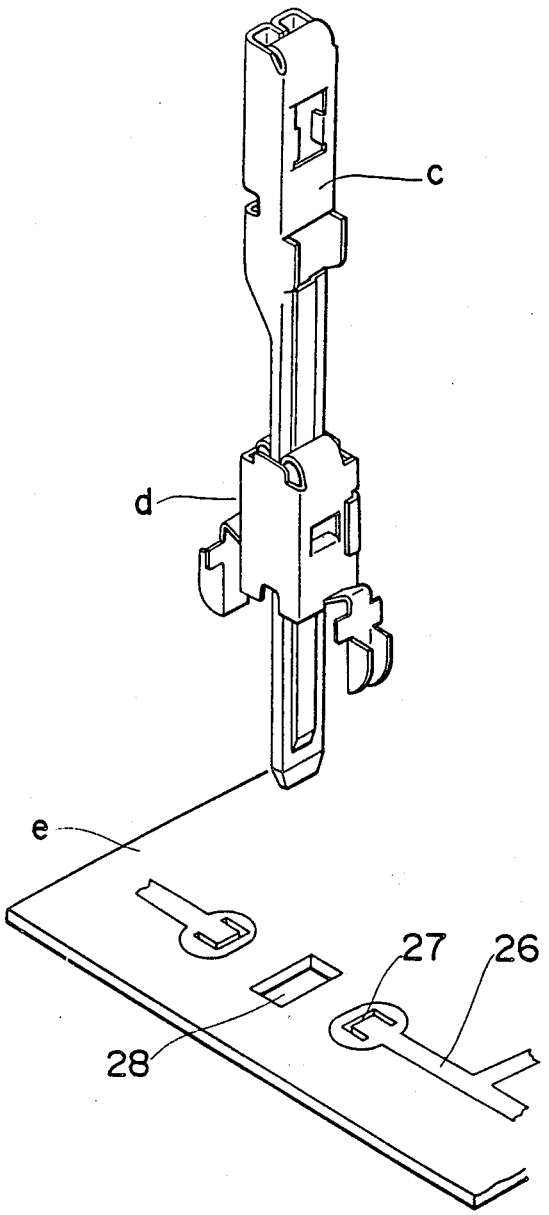
FIG. 5 is a perspective view showing a method of mounting the through terminal and the branch terminal on a printed circuit plate.

As shown in FIG. 5, square rounds 27 for the lead terminals 23 of the branch terminal d are formed at the end parts of a signal circuit 26 extended at the side edge of the printed circuit plate e, and an insertion hole 28 for the external output terminal portion $c_2$ is provided in proximity to the rounds 27.

In assembling the electronic unit and forming the through circuit, the lead terminals 23 are inserted into the rounds 27 of the printed circuit plate e and are soldered. Thus, the branch terminal d is stably fixed on the printed circuit plate e perpendicularly thereto. The soldering of the lead terminals 23 can be automatically performed simultaneously with that of the capacitor 6*a*, the resistor 6*b*, the LSI 6*c* and other electronic components.

Subsequently, the external output terminal portion (male terminal) $c_2$ of the through terminal c is inserted between the elastic sandwiching pieces 19, 19 of the branch terminal d into elastic contact with the pieces, and the lower end of the terminal portion $c_2$ is caused to penetrate the insertion hole 28. Thus, the through terminal c and the signal circuit 26 are electrically connected via the branch terminal d. Under this state, the J. B.

coupling connector 8 as required is fixed to the printed circuit plate e with the screw or the like as described before. A plurality of through terminals c as described above may well be collectively mounted in such a way that they are inserted into respective accommodation chambers 8*a* within the J. B. coupling connector 8 and are retained in engagement by the engagement holes 14 and engagement arms 8*b* within the chambers in advance.

Lastly, the upper case 4 and the lower case 5 are placed on the J. B. a. Then, the installation of the electronic unit b is completed.

In FIG. 1, the tab terminal 3 from the J.B. a is inserted into the J. B. connecting portion $c_1$ of the through terminal c and is held in contact with the elastic contact piece 13. Meanwhile, the external output terminal portion $c_2$ of the through terminal c passes between the elastic sandwiching pieces 19, 19 of the branch terminal d as stated above, and the distal end thereof protrudes into the accommodation chamber 7*a* of the external coupling connector 7.

In the state in which the through terminal c is mounted on the J. B. coupling connector 8, the torsion preventing pieces 15 are held in engagement with grooves (not shown) within the accommodation chamber 8*a*, and hence, the oscillations of the through terminal c in lateral directions indicated by arrows P are prevented. Moreover, when the through terminal c is kept in custody or is assembled, the erroneous insertion-preventing piece 16 prevents the erroneous insertion of another terminal in the direction of an arrow Q and the entanglement of the terminals. Furthermore, the external output terminal portion $c_2$ of the through terminal c is not formed into a mere plate but is hollow-formed, so that the deformations etc. in the directions of arrows R are less prone to take place.

Next, the branch terminal d has the lead terminals 23 provided with the S-shaped elastic crooked portions 22. Therefore, even when the receptacle portion 18 is subjected to lateral and vertical external forces as indicated by arrows S and T, it can accommodate them. That is, even if some degrees of deviations are involved in the position of the fixation of the branch terminal d to the printed circuit plate e and the inserted position of the through terminal c, they can be compensated by the cushioning of the elastic crooked portions 22.

In this manner, the branch terminal d is provided with the lead terminals 23 having the cushion function, the respective connection parts of both the terminals c and d are provided with the elastic mechanism (the elastic contact piece 13, the elastic sandwiching pieces 19), and the rattle preventing mechanisms (the torsion preventing pieces 15, the hollow male terminal $c_2$ ) in the through terminal c are provided. Thus, each connection part does not exert an external force which deforms another connection part, or it does not undergo an external force which deforms it, either. Therefore, stable electrical connections of high reliability are attained, and the terminals are easily fabricated and assembled without requiring high dimensional accuracies.

Besides, the formation of the through circuit on the printed circuit plate e can be almost dispensed with by the through terminal c and the branch terminal d. This serves for the miniaturization of the electronic unit b owing to the simplification of a circuit arrangement and the elimination of a dead space.

As understood from the above description, the function-preset wiring device for an automobile according to the present invention consists in that a through terminal constituting a through circuit is made separate from a tab terminal extending from a J. B. and that the respective connection parts of the through terminal and a branch terminal are endowed with cushion functions. Therefore, stable electrical connections can be performed without being affected by the deviations of the assembled positions of the terminals, the dimensional errors of the terminals, etc., and the assembling and connecting operations of the J. B. and an electronic unit are facilitated.

What is claimed is:

1. A through terminal integrally formed of a metallic base plate having a generally elongated planar structure with first and second end portions, said first end portion including an elastic contact piece extending from a longitudinal end of the base plate and folded backwardly in parallel to said planar structure and a pair of elastic arms erected from lateral sides of said base plate and folded inwardly and back toward said folded elastic contact piece, said folded elastic contact piece and folded pair of elastic arms cooperating to form a female terminal section for receiving a tab terminal from a bus bar circuit such that said first end portion forms a junction block connection section, said second end portion including a pair of integral flap portions integrally extending longitudinally along lateral sides of said base plate folded to lap thereover to form a generally planar tab-shaped male terminal, said base plate having an exposed surface formed with a bead extending longitudinally at said second end portion.

2. A branch terminal formed of a unitary metallic plate and having a box-shaped receptacle portion having a pair of opposing walls with respective entrance ends and exit ends, said branch terminal having a pair of elastic sandwiching portions folded from said entrance ends thereof and extending into said box-shaped receptacle portion to face each other therein and a pair of lead terminal portions struck laterally outwardly and bent longitudinally outwardly with respect to said box-shaped receptacle portion such that said pair of lead terminal portions are insertable into a printed circuit board.

* * * * *